US008746195B2

(12) United States Patent
Werler et al.

(10) Patent No.: US 8,746,195 B2
(45) **Date of Patent: *Jun. 10, 2014**

(54) VARIABLE VALVE TRAIN FOR INTERNAL COMBUSTION ENGINES FOR ACTUATING GAS EXCHANGE VALVES

(75) Inventors: Andreas Werler, Zwickau (DE); Thomas Arnold, Stollberg (DE); Heiko Neukirchner, Chemnitz (DE); Joerg Wutzler, Zwickau (DE)

(73) Assignee: IAV GmbH Ingenieurgesellschaft Auto und Verkehr, Berlin (DE)

( * ) Notice: Subject to any disclaimer, the term of this patent is extended or adjusted under 35 U.S.C. 154(b) by 92 days.

This patent is subject to a terminal disclaimer.

(21) Appl. No.: 13/389,462

(22) PCT Filed: Aug. 3, 2010

(86) PCT No.: PCT/DE2010/000932

§ 371 (c)(1),
(2), (4) Date: Feb. 8, 2012

(87) PCT Pub. No.: WO2011/018075

PCT Pub. Date: Feb. 17, 2011

(65) Prior Publication Data

US 2012/0138001 A1 Jun. 7, 2012

(30) Foreign Application Priority Data

Aug. 10, 2009 (DE) ..... 10 2009 037 268

(51) Int. Cl.
*F01L 1/34* (2006.01)

(52) U.S. Cl.
USPC ..... 123/90.18

(58) Field of Classification Search
USPC ..... 123/90.17, 90.18, 90.6
See application file for complete search history.

(56) References Cited

U.S. PATENT DOCUMENTS

| | | | |
|---|---|---|---|
| 3,481,314 | A | 12/1969 | Lecrenn |
| 5,289,806 | A | 3/1994 | Hurr |
| 5,509,384 | A | 4/1996 | Schmid |
| 6,382,149 | B1 | 5/2002 | Fischer et al. |

(Continued)

FOREIGN PATENT DOCUMENTS

| | | | |
|---|---|---|---|
| DE | 3934848 | A1 | 4/1991 |
| DE | 4230877 | A1 | 4/1993 |

(Continued)

*Primary Examiner* — Thomas Denion
*Assistant Examiner* — Steven D Shipe
(74) *Attorney, Agent, or Firm* — Leydig, Voit & Mayer, Ltd.

(57) ABSTRACT

A variable valve train for actuating a plurality of gas exchange valves of an internal combustion engine includes a plurality of individual cam sleeves axially displaceable relative to one another and disposed so as to form the camshaft. Each of the plurality of individual cam sleeves include a plurality of different cam profiles. A switching shaft is disposed inside the plurality of cam sleeves and is configured to rotate together with the plurality of cam sleeves. A switching ball operatively connects one of the plurality of cam sleeves to a switching contour disposed on the switching shaft. A displacement piece is disposed so as to be rotationally engaged but axially displaceable on one of the plurality of cam sleeves and connected to the switching shaft. An actuator is operatively connectable to the displacement piece by the switching ball so as to displace the one of the plurality of cam sleeves.

20 Claims, 2 Drawing Sheets

(56) References Cited

U.S. PATENT DOCUMENTS

| | | | | |
|---|---|---|---|---|
| 7,198,015 | B2 * | 4/2007 | Mobley | 123/90.18 |
| 8,230,833 | B2 * | 7/2012 | Werler et al. | 123/90.6 |
| 8,307,794 | B2 | 11/2012 | Lengfeld et al. | |
| 2004/0139936 | A1 * | 7/2004 | Mitchell | 123/90.16 |
| 2010/0242884 | A1 | 9/2010 | Meintschel et al. | |
| 2011/0226205 | A1 * | 9/2011 | Kraus | 123/90.18 |
| 2012/0037106 | A1 | 2/2012 | Werler et al. | |
| 2012/0125273 | A1 * | 5/2012 | Werler et al. | 123/90.6 |
| 2012/0138000 | A1 * | 6/2012 | Schadel et al. | 123/90.18 |
| 2012/0138001 | A1 | 6/2012 | Werler et al. | |
| 2012/0227689 | A1 * | 9/2012 | Bechtold | 123/90.6 |
| 2013/0025554 | A1 * | 1/2013 | Werler et al. | 123/90.18 |

FOREIGN PATENT DOCUMENTS

| | | | |
|---|---|---|---|
| DE | 4331977 | A1 | 5/1995 |
| DE | 4416505 | A1 | 11/1995 |
| DE | 19520117 | A1 | 12/1996 |
| DE | 19825307 | A1 | 12/1999 |
| DE | 10054623 | A1 | 5/2002 |
| DE | 102007016977 | A1 | 10/2008 |
| DE | 102007027979 | A1 | 1/2009 |
| DE | 102007054978 | A1 | 5/2009 |
| DE | 102009037268 | B3 | 4/2011 |
| DE | 102009037270 | B4 | 4/2011 |
| DE | 102009037269 | B4 | 6/2011 |
| DE | 102009017242 | B4 | 9/2011 |
| EP | 0579592 | A1 | 1/1994 |

* cited by examiner

VARIABLE VALVE TRAIN FOR INTERNAL COMBUSTION ENGINES FOR ACTUATING GAS EXCHANGE VALVES

CROSS REFERENCE TO PRIOR APPLICATIONS

This application is a U.S. National Phase application under 35 U.S.C. §371 of International Application No. PCT/DE2010/000932, filed on Aug. 3, 2010, and claims benefit to German Patent Application No. DE 10 2009 037 268.7, filed on Aug. 10, 2009. The International Application was published in German on Feb. 17, 2011 as WO 2011/018075 under PCT Article 21(2).

FIELD

The invention relates to a variable valve train for internal combustion engines for actuating gas exchange valves.

Gas exchange valves of an internal combustion engine can be operated in a variable manner, with different opening and closing times and with different valve opening lifts. A valve control system of this type is described in DE 42 30 877 A1. In this document, a cam support having two different cam contours is arranged so as to be rotationally engaged but axially displaceable on a camshaft. Depending on the axial position of the cam support, one cam contour is operatively connected to the lift valve via an intermediate member (transmission lever). The cam support is axially displaced during the base cycle phase by means of a thrust collar, counter to the action of a pull-back spring, to change the valve parameters.

A drawback in this case is the large amount of space required for adjusting the cam support. These solutions can therefore only be used with relatively large cylinder spacings, so that the relevant components can be accommodated. A further drawback is the high inertial forces during the adjustment process which are required for displacing the cam support or the adjustment members. It is only possible to switch to a corresponding cam contour in a cylinder-selective manner. Valve-selective switching is not possible.

DE 100 54 623 A1 describes a device for switching a cam support on a camshaft for actuating gas exchange valves, in which the cam support is guided in axial displacement on the camshaft. The gas exchange valve is operatively connected to different cam contours depending on the position of the cam support. The cam support is adjusted via an adjustment element in cooperation with a slide path. In this case, the adjustment element is a radially outwardly displaceable pin, which, when extended, cooperates with at least two slide paths formed in a guide part arranged through approximately 180° around the cam support.

A drawback of this solution, further to the additional space for the guide part, is that to switch to a different cam contour, the pin has to be extended from the camshaft and slid into an axially displaceable switch slide. After the switching process, the pin has to be retracted again. This construction has high requirements in terms of parts and manufacturing, and there is a risk of damage to the camshaft as a result of incorrect switching of the pin. A further drawback is that the necessary adjustment time of the pin restricts the rotational speed of the motor. In addition, the adjustment is dependent on the oil pressure provided in each case.

Further, a valve train of an internal combustion engine is described in DE 195 20 117 C2, in which an axially displaceable cam support having at least two different cam paths is arranged rotationally engaged on the camshaft. The cam support is adjusted by means of an adjustment member, which is guided inside the camshaft. A double-action hydraulic or pneumatic piston cylinder unit, arranged on an end face of the camshaft, displaces the undulating adjustment member inside the camshaft counter to the compression of a spring. The adjustment member is connected to an entrainment piece, which penetrates through a slot arranged axially in the camshaft and extends into a hole in the cam support.

The drawback of this solution is that by axially displacing the adjustment member, it is possible to displace only a plurality of cam supports arranged on the camshaft simultaneously. Different switching of individual cam supports on a camshaft is not possible. A further drawback is that in a switching position in which an external cam is engaged in the gas exchange valves, the spring element is constantly under tension. This results in high lateral frictional forces between the entrainment piece and the guide path arranged on the adjustment member. This leads to increased wear and possible related incorrect switchings. A further drawback is that the acting spring forces have to be adjusted precisely so as to prevent incorrect switchings, in particular when switching back to the central cam profile if there are three different cam profiles.

DE 10 2009 017 242, held by the Applicant, has already described a valve train for actuating gas exchange valves of internal combustion engines. In the valve train, the cam support is displaced on the camshaft tube, for valve switching, by a switching shaft rotatably arranged inside the camshaft tube. The switching shaft is provided with a switching contour having an axial inclination. A switching ball, which is mounted in a hole of an axially displaceable switching sleeve which encircles the switching shaft, is guided in the switching contour. The switching sleeve is operatively connected to the cam support via a dog. When the switching shaft is rotated, the switching sleeve is axially displaced via the switching ball and the cam support is axially displaced via the dog.

The arrangement of a switching sleeve between the switching shaft and the camshaft tube leads to frictional forces which additionally have to be overcome. Moreover, the solution by way of the switching sleeve arrangement has high parts requirements.

SUMMARY

In an embodiment, the present invention provides a variable valve train for actuating a plurality of gas exchange valves of an internal combustion engine, wherein a crankshaft of the internal combustion engine drives a camshaft. A plurality of individual cam sleeves axially is displaceable relative to one another and is disposed so as to form the camshaft, each of the plurality of individual cam sleeves including a plurality of different cam profiles each having a same base circle portion, the plurality of different cam profiles being configured to engage, by switching, one of the plurality of gas exchange valves. A switching shaft is disposed inside the plurality of cam sleeves and is configured to rotate together with the plurality of cam sleeves. A switching ball operatively connects one of the plurality of cam sleeves to a switching contour disposed on the switching shaft. A displacement piece is disposed so as to be rotationally engaged but axially displaceable on one of the plurality of cam sleeves and connected to the switching shaft. An actuator is operatively connectable to the displacement piece by the switching ball for displacing the one of the plurality of cam sleeves, wherein the switching ball is configured to slide in the switching contour so as to rotate the switching shaft relative to the one of the plurality of cam sleeves.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

In an embodiment, the present invention provides a variable valve train for actuating gas exchange valves of internal combustion engines which is distinguished by a simplified construction together with a reduction in the frictional forces.

According to an embodiment of the invention, the valve train for internal combustion engines for actuating gas exchange valves consists of a camshaft which is driven by a crankshaft of the internal combustion engine and which consists of a plurality of individual cam sleeves which are axially displaceable relative to one another. The individual cam sleeves which are axially displaceable relative to one another are interconnected via an axially extending toothing, the toothings of the respectively adjacent cam sleeves being formed so as to mesh. A plurality of different cam profiles having the same base circle portion are arranged on each cam sleeve, and can be engaged with the gas exchange valves by displacing the individual cam sleeves. A switching shaft is arranged inside the cam sleeves which rotates together with the cam sleeves and is operatively connected to the respective cam sleeve via a switching ball in each case. The switching balls are each mounted rigidly in each cam sleeve and slidingly in a switching contour arranged on the switching shaft. The switching shaft is connected via a transmission to a displacement piece which is fixed in rotation but axially displaceable on the cam sleeve. An actuator which is arranged rigidly on the housing of the internal combustion engine can be operatively connected to the displacement piece so as to rotate the switching shaft relative to the cam sleeves.

The advantage of a solution according to an embodiment of the invention is a simple construction of the actuation device for reliably switching valves between different cam profiles of the camshaft, in which the friction between the individual components is also reduced.

Further advantageous configurations are disclosed in the dependent claims and explained in the description together with the effects thereof.

Figure 1:
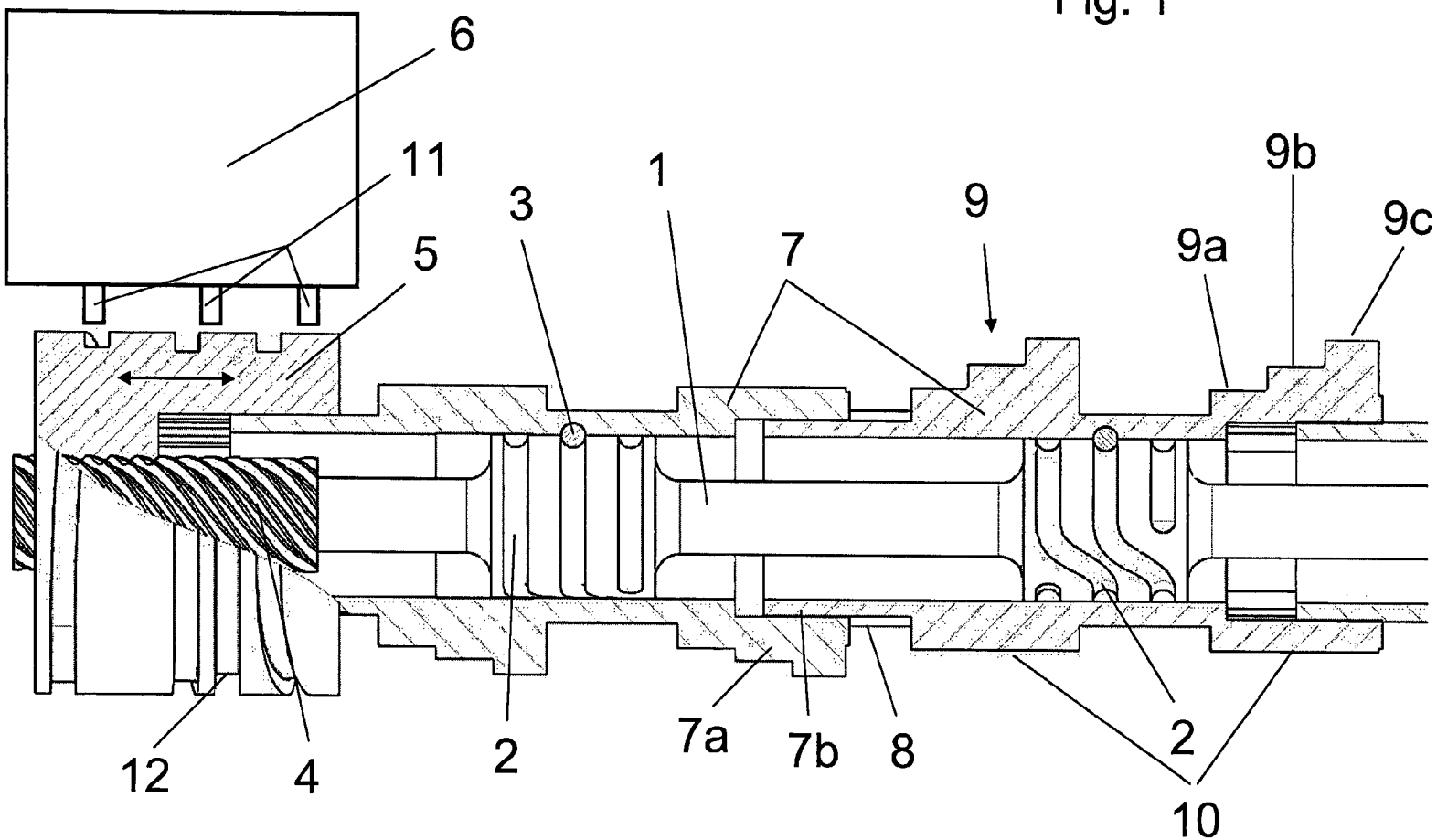
FIG. 1 is a sectional view of the solution according to an embodiment of the invention.

FIG. 1 shows a sub-region of a valve train of an internal combustion engine. The valve train for actuating gas exchange valves consists of a camshaft which is driven by a crankshaft of the internal combustion machine and consists of a plurality of individual cam sleeves 7 which are axially displaceable relative to one another. An axially displaceable cam sleeve 7 is associated with each cylinder of a multi-cylinder internal combustion engine, and, according to an embodiment, two gas exchange valves of a cylinder can be actuated by each cam sleeve 7 by way of the two cam profiles 9 arranged thereon. The cam sleeve 7 has a plurality of differently formed cam profiles 9*a*, 9*b* and 9*c* having an identical base circle portion 10, which for valve lift switching are each selectively brought into contact with a respective gas exchange valve, directly or via intermediate members, by displacing the cam sleeve 7. In the embodiment shown, each cam sleeve 7 has two cam profiles 9, each having a small cam profile 9*a*, a medium cam profile 9*b* and a large cam profile 9*c* for actuating the two gas exchange valves. It is perfectly conceivable for the cam profiles 9 of each cam sleeve 7 to consist of only two or more than three differently sized cam profiles. To achieve a phase shift between the different cam profiles 9*a*, 9*b* and 9*c*, the curves of the cam profiles 9*a*, 9*b* and 9*c* may be arranged mutually offset.

The individual cam sleeves 7 which are axially displaceable relative to one another are interconnected by an axially extending toothing 8. The cam sleeves 7 are thus formed in such a way that the toothing 8 of respectively adjacent cam sleeves 7*a* and 7*b* meshes. This provides that the individual cam sleeves 7 are axially displaceable and rotationally engaged relative to one another. A switching shaft 1 is arranged inside the cam sleeves 7 and, apart from during the switching process, rotates synchronously with the cam sleeve 7. Each cam sleeve 7 is operatively connected to the switching shaft 1 via a switching ball 3. The switching ball 3 is mounted in a hemispherical recess of the respective cam sleeve 7 and slidingly in a switching contour 2 arranged on the switching shaft 1. The switching contour 2 arranged on the switching shaft 1 for each cam sleeve 7 has an axial inclination. The axial inclination results in a spiral switching contour 2 on the surface of the switching shaft 1, the respective starts of the contours on the switching shaft 1 being arranged evenly or mutually offset on the circumference, depending on the axial displacements to be carried out by the individual switching sleeves 7. If the individual cam sleeves 7 are to be axially displaced in succession, the individual axial inclinations of the switching contours 2 arranged for the respective cam sleeves 7 are arranged mutually offset on the circumference of the switching shaft 1. This variant is shown in FIG. 1. If the individual cam sleeves 7 are to be axially displaced simultaneously, the individual axial inclinations of the switching contours 2 arranged for the respective cam sleeves 7 are positioned in the same axial plane on the circumference of the switching shaft 1.

According to FIG. 1, the switching shaft 1 is connected via a threaded shaft 4 to a displacement piece 5, which is rotationally engaged but axially displaceable on a cam sleeve 7. In this case, the cam sleeve 7 and the displacement piece 5 are connected via meshing axial toothing 13. The threaded shaft 4 of the switching shaft 1 is in the form of oblique toothing and engages in the matching toothing of the displacement piece 5. The displacement piece 5 can be operatively connected to an actuator 6 which is rigidly connected to a housing of the internal combustion engine. Thus, when the actuator 6 is actuated, a pin 11 arranged on the actuator 6 engages in the contour 12 arranged on the circumference of the displacement piece 5. The displacement piece 5 is axially displaceable on the first cam sleeve 7 in both directions, as shown by the double-headed arrow in the drawings.

Figure 2:
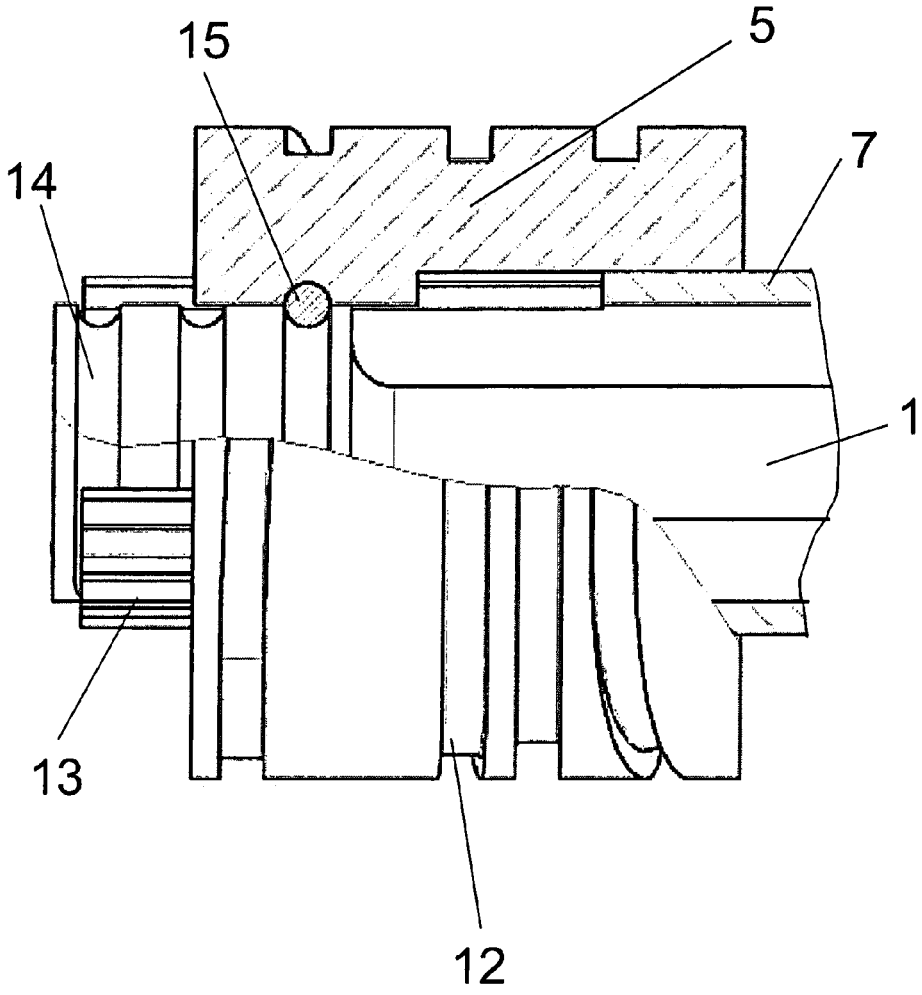
FIG. 2 is a half-sectional view of an embodiment of the solution according to an embodiment of the invention in the form of a single unit.

FIG. 2 shows a variant of the connection of the switching shaft 1 to the displacement piece 5 which is axially displaceable on a cam sleeve 7. In this case, the switching shaft 1 is connected to the displacement piece 5 via a cam mechanism. The cam mechanism consists of a switching contour 14 arranged on the circumference of the switching shaft 1, a switching ball 15 being mounted slidingly in said switching contour and in turn being mounted in a hemispherical recess arranged on the inner circumference of the displacement piece 5. The displacement piece 5 is also displaced by an actuator 6.

The variable valve drive operates as follows to provide switching between the different cam profiles 9*a*, 9*b* and 9*c*.

While the central cam profile 9*b* of the cam sleeve 7*a* is engaged with the gas exchange valves, for example, the cam sleeve 7, the switching shaft 1 and the displacement piece 5 rotate at a synchronous rotational speed. The actuator 6 is not engaged with the displacement piece 5. It is only possible to switch to another cam profile when the base circle portion 10 is engaged with the gas exchange valve or the intermediate member. To switch the engagement of the cam profile 9*b* on the gas exchange valve to the cam profile 9*a* or the cam profile 9*c*, the actuator 6 is activated by an appropriate actuation and brought into engagement with the displacement piece 5. In the disclosed embodiment, this is provided in that a pin 11 is extended towards the displacement piece 5 and latches into the contour 12 arranged on the circumference of the displacement piece 5. Depending on the actuated pin 11, the displacement piece 5 is axially displaced to the right or to the left relative to the cam sleeve 7, in accordance with the switching process to be carried out, by the pin 11, which slides in the contour 12. The axial movement of the displacement piece 5 is transformed into a rotation of the switching shaft 1 via the threaded shaft 4 according to FIG. 1 or via the cam mechanism according to FIG. 2. This results in rotation of the switching shaft 1 relative to the cam sleeves 7. The relative rotation causes the switching ball 3 to slide in the path of the switching contour 2. Based on the relative rotation and the individual switching contours 2 which are operatively connected to each cam sleeve 7 via the switching balls 3, the cam sleeves 7 are axially displaced relative to one another, resulting in switching between the individual cam profiles 9*a*, 9*b* and 9*c*.

The displacement piece 5 may also for example be displaced by an actuator which acts magnetically on the displacement piece 5.

The advantage of the solution according to the invention is a small, simple construction of the valve train, with which valve switchings variably adapted to the motor are possible.

While the invention has been described with reference to particular embodiments thereof, it will be understood by those having ordinary skill the art that various changes may be made therein without departing from the scope and spirit of the invention. Further, the present invention is not limited to the embodiments described herein; reference should be had to the appended claims.

LIST OF REFERENCE NUMERALS

1 switching shaft
2 switching contour
3 switching ball
4 threaded shaft
5 displacement piece
6 actuator
7 cam sleeve
8 toothing
9 cam profile
9*a* small cam profile
9*b* medium cam profile
9*c* large cam profile
10 base circle portion
11 pin
12 contour
13 axial toothing
14 switching contour
15 switching ball

The invention claimed is:

1. A variable valve train for actuating a plurality of gas exchange valves of an internal combustion engine, wherein a crankshaft of the internal combustion engine drives a camshaft, the valve train comprising:

a plurality of individual cam sleeves axially displaceable relative to one another and disposed so as to form the camshaft, each of the plurality of individual cam sleeves including a plurality of different cam profiles each having a same base circle portion, the plurality of different cam profiles being configured to engage, by switching, one of the plurality of gas exchange valves;

a switching shaft disposed inside the plurality of cam sleeves and configured to rotate together with the plurality of cam sleeves;

a switching ball operatively connecting one of the plurality of cam sleeves to a switching contour disposed on the switching shaft;

an actuator; and a displacement piece disposed so as to be rotationally engaged but axially displaceable on one of the plurality of cam sleeves and connected to the switching shaft;

wherein, for displacing each cam sleeve by means of the switching ball, the displacement piece is operatively connectable to the actuator so as to rotate the switching shaft relative to the cam sleeve.

2. The valve train as recited in claim 1, wherein each of the plurality of cam sleeves include an axially extending toothing configured to interconnect one of the plurality of cam sleeves to an adjacent one of the plurality of cam sleeves with the axially extending toothing of the one of the plurality of cam sleeves forming a mesh with the axially extending toothing of the adjacent one of the plurality of cam sleeves.

3. The valve train as recited in claim 1, wherein the actuator is rigidly connected to a housing of the internal combustion engine.

4. The valve train as recited in claim 1, wherein the switching contour includes an axial inclination.

5. The valve train as recited in claim 1, wherein the switching ball is disposed in a hemispherical recess of one of the plurality of cam sleeves.

6. The valve train as recited in claim 1, wherein the plurality of cam supports are configured to be axially displaced in succession, and wherein the respective switching contours each include an axial inclination, the axial inclinations of the respective switching contours being mutually offset with respect to each other on a circumference of the switching shaft.

7. The valve train as recited in claim 1, wherein the plurality of cam supports are configured to be axially displaced simultaneously, and wherein the respective switching contours each include an axial inclination, the axial inclinations of the respective switching contours being disposed in a same axial plane on a circumference of the switching shaft.

8. The valve train as recited in claim 1, further comprising a threaded shaft connecting the switching shaft to the displacement piece.

9. The valve train as recited in claim 8, wherein the threaded shaft includes an oblique toothing which forms the connection between the switching shaft and the displacement piece.

10. The valve train as recited in claim 1, further comprising a cam transmission connecting the switching shaft to the displacement piece.

11. The valve train as recited in claim 2, wherein the actuator is rigidly connected to a housing of the internal combustion engine.

12. The valve train as recited in claim 2, wherein the switching contour includes an axial inclination.

13. The valve train as recited in claim 3, wherein the switching contour includes an axial inclination.

14. The valve train as recited in claim 11, wherein the switching contour includes an axial inclination.

15. The valve train as recited in claim 2, wherein the switching ball is disposed in a hemispherical recess of one of the plurality of cam sleeves.

16. The valve train as recited in claim 3, wherein the switching ball is disposed in a hemispherical recess of one of the plurality of cam sleeves.

17. The valve train as recited in claim 4, wherein the switching ball is disposed in a hemispherical recess of one of the plurality of cam sleeves.

18. The valve train as recited in claim 11, wherein the switching ball is disposed in a hemispherical recess of one of the plurality of cam sleeves.

19. The valve train as recited in claim 12, wherein the switching ball is disposed in a hemispherical recess of one of the plurality of cam sleeves.

20. The valve train as recited in claim 13, wherein the switching ball is disposed in a hemispherical recess of one of the plurality of cam sleeves.

* * * * *